US005211275A

United States Patent [19]

Halsey et al.

[11] Patent Number: 5,211,275

[45] Date of Patent: May 18, 1993

[54] CAR WASH COIN/TOKEN COLLECTION SYSTEM

[75] Inventors: James H. Halsey, El Dorado; James W. Erwin, Bearden, both of Ark.

[73] Assignee: IDX, Inc., El Dorado, Ark.

[21] Appl. No.: 876,165

[22] Filed: Apr. 30, 1992

Related U.S. Application Data

[62] Division of Ser. No. 640,720, Jan. 14, 1991, Pat. No. 5,129,501.

[51] Int. Cl.[5] ..... G07F 9/06

[52] U.S. Cl. ..... 194/350

[58] Field of Search ..... 194/350, 904; 312/333; 292/144; 232/12, 15, 16, 43.2; 109/50-52, 45, 47, 59 R

[56] References Cited

U.S. PATENT DOCUMENTS

| | | | |
|---|---|---|---|
| 1,986,840 | 1/1935 | Meilink | 312/333 |
| 2,819,692 | 1/1958 | Johnson et al. | 109/50 |
| 2,964,237 | 12/1960 | Henderson | 232/16 |
| 3,610,176 | 10/1971 | Fujiki | 109/52 X |
| 3,979,054 | 9/1976 | Graham | 232/16 X |
| 4,177,889 | 12/1979 | Adams et al. | 194/350 |
| 4,398,470 | 8/1983 | Williams et al. | 109/45 X |
| 4,579,214 | 4/1986 | Volk | 194/350 |
| 4,655,145 | 4/1987 | Naylor | 109/50 X |

FOREIGN PATENT DOCUMENTS

| | | | |
|---|---|---|---|
| 177176 | 3/1922 | United Kingdom | 292/144 |

*Primary Examiner*—Michael S. Huppert
*Assistant Examiner*—William M. Hienz
*Attorney, Agent, or Firm*—Diller, Ramik & Wight

[57] ABSTRACT

A car wash system includes a pair of car washing areas to either side of an upstanding wall, a pair of coin/token boxes within the upstanding wall with each having a front face opening toward an associated car was area, a coin/token vault within the upstanding wall below the pair of coin/token boxes, and a pair of tubes leading from the coin/token box to the coin/token vault whereby coins/tokens deposited in the coin/token boxes are guided into the coin/token vault.

18 Claims, 4 Drawing Sheets

CAR WASH COIN/TOKEN COLLECTION SYSTEM

This application is a division of application Ser. No. 07/640,720, filed Jan. 14, 1991, now U.S. Pat. No. 5,129,501.

CROSS-REFERENCE TO RELATED APPLICATION

This application is directed to a car wash coin/token collection system which includes as a part thereof a meter box, such as that disclosed in pending Application Ser. No. 07/523,944 filed May 16, 1990 in the names of James H. and Johnny H. Halsey entitled METER BOX WITH REMOVABLE HINGED DOOR and now U.S. Pat. No. 5,121,824.

BACKGROUND OF THE INVENTION

This invention related to car wash systems in general, but specifically to car washes which include one or more car wash bays each serviced by a "wand" applicator or nozzle. An individual drives his car into a car wash bay, places a coin or token into a coin/token meter box, and manually sets a dial to perform a specific car wash operation. Typically such dials might be turned manually through the consecutive operations of "presoak," "wash," "rinse," and "wax," and during this typical cycle of operation a person directs the spray from the wand nozzle against the automobile in a known manner.

It is not uncommon to accumulate up to $1500.00 in quarters per week per meter box, and this has resulted in theft, attempted theft and/or meter box destruction. Even when the meter box is emptied on a daily basis, sufficient coins accumulate to make theft attractive. Even if the meter boxes are not successfully broken into by thieves, they are often rendered inoperative. Some conventional meter boxes use combination locks, and if thieves cannot open these, they simply break off the dial, bang up the associated spline of the dial shaft, and this obviously requires subsequent repair and/or replacement with attendant cost to the car wash owner. It is not uncommon for frustrated thieves to pour Super Glue down the keyholes of key-lock meter boxes when they have been thwarted in their efforts of opening the same. It is not uncommon for thieves to use crowbars, sledge hammers and even attempt to rip the meter boxes from supporting walls by chaining the same to a vehicle which is accelerated in an effort to rip the meter box from its support structure.

SUMMARY OF THE INVENTION

With the foregoing description of conventional car wash systems in mind, the present invention overcomes the disadvantages noted by providing a novel coin/-token vault which is essentially entirely embedded in the masonry of a vertical upstanding wall in part defining a car wash bay. This coin/token box is located twelve to eighteen inches from the floor and includes a stainless steel housing having an opening which receives a sliding stainless steel drawer. An opening is formed in a top wall of the housing and a stainless steel tube is connected between this opening and an opening formed in an associated meter box or coin acceptor located at a higher level in the same upstanding wall. The meter box is also virtually entirely embedded in the upstanding wall except for an exposed face which includes the coin/token slot, selection dial, etc. Coins/-tokens which are fed into the coin acceptor travel through the tube and are deposited in the drawer of the coin/token vault and accumulate therein. Since the coin/token vault is embedded in the upstanding wall, which is generally masonry such as cinder block or brick, it is virtually impossible to rip the coin/token vault from the wall. Furthermore, only one face of the coin/token vault is exposed and this face has only planar surfaces which prevent a chain or cable from being secured thereto should a thief try to rip the vault from the wall by attaching a chain or cable to a vehicle as earlier mentioned. Furthermore, the tolerances between the housing and the drawer of the vault are so precise that a crowbar or the like cannot be used to pry the drawer from the housing.

One might expect that if a thief was frustrated in efforts at opening the coin/token vault he might turn his attention to the coin acceptor/meter box because it at least includes a coin slot, a coin return slot, the selection knob, etc. which provide points of access for crowbars, screwdrivers and similar instruments employed by thieves. However, even if the meter box were successfully jimmied open through its conventional front door, all of the coins/tokens received therein have passed through the tube and are located in the vault and there is no reasonable method of "fishing" the coins/tokens out of the vault through the coin/token tube. Therefore, irrespective of the particular approach taken by a thief, access to the coins or tokens in the vault is virtually precluded.

In further keeping with this invention, preferably two coin/token boxes are associated with each coin/token vault with one coin/token box facing one car wash bay and the other facing an adjacent car wash bay on opposite sides of the same upstanding wall. In this fashion, a single coin/token vault can be fed coins/tokens from two separate though adjacent car wash bays.

In further accordance with this invention, the novel coin/token vault includes a drawer having a tongue with an opening into which a pin drops by gravity, and the pin is connected to the cores of two electromagnetic coils, each of which individually has sufficient strength to raise the pin and remove it from the drawer opening to release the drawer and permit access to the coins/-tokens therein. Thus, should one of the coils fail the other, when energized, will draw the pin upwardly and allow the drawer to be released and opened. Obviously, if but a single magnetic coil were used and it became defective in the locked position of the pin, it would be virtually impossible to open the vault without destroying the same.

DESCRIPTION OF THE PREFERRED EMBODIMENT

Figure 1:
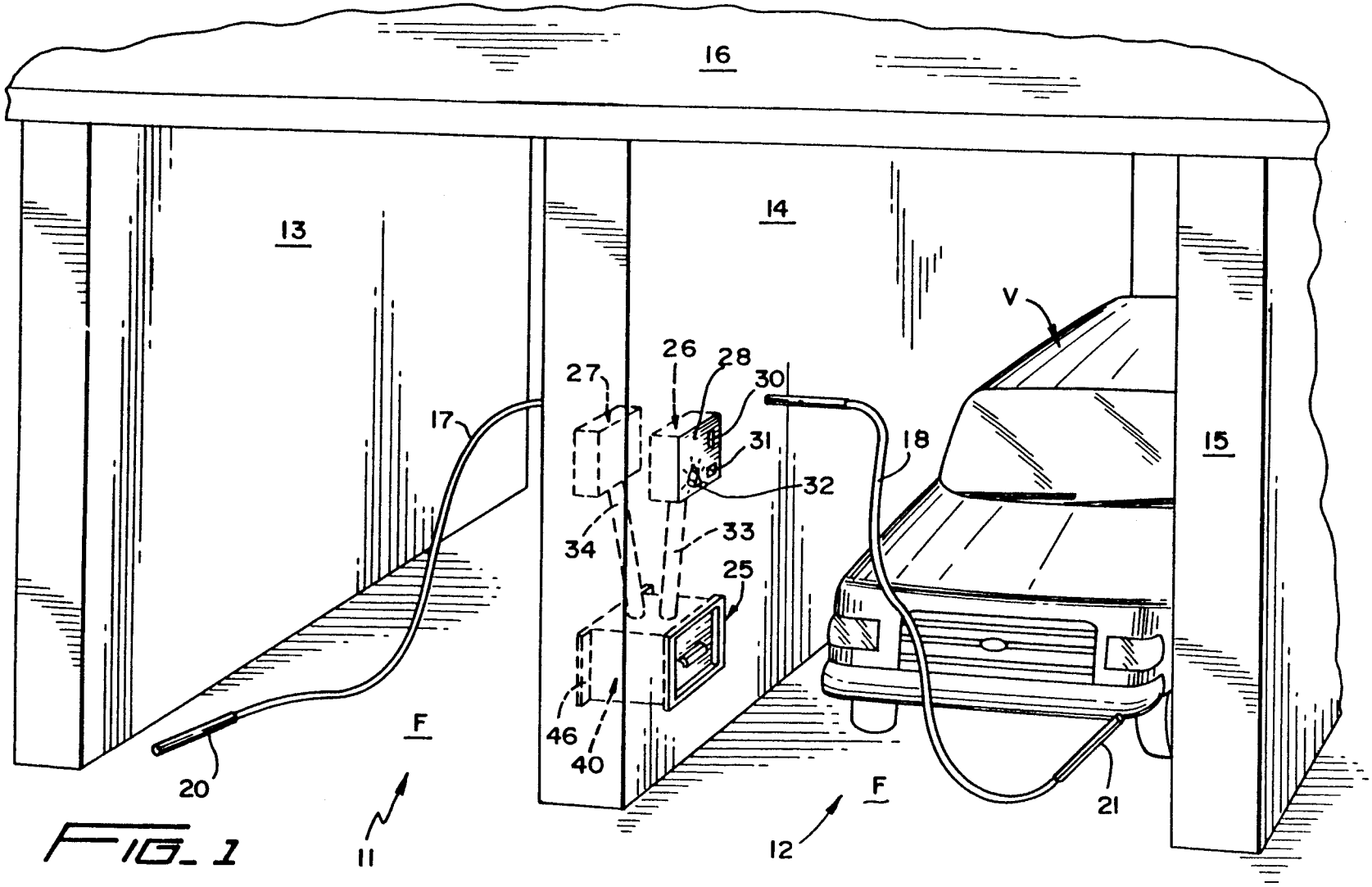
FIG. 1 is a fragmentary perspective view of a car wash coin/token collection system constructed in accordance with this invention, and illustrates several car washing bays, an upstanding wall between two of the bays, and a coin-token vault, tow coin/token guide tubes and two coin/token metering boxes or acceptors associated therewith.

A novel car wash coin/token collection system constructed in accordance with this invention is generally illustrated in FIG. 1 and is designated by the reference numeral 10.

The car wash system 10 includes typical car wash bays 11, 12 defined by upstanding walls 13, 14; 14, 15 and a roof 16. A flexible hose 17, 18 is piped through the wall 14 to a conventional source of water, and a conventional system (not shown) which meters soap, wax or the like therein. Water or an admixture thereof can be applied to a vehicle V through a wand or nozzle 20, 21 of the associated flexible hoses 17, 18, respectively, in a well known manner.

The upstanding wall 14 projects upwardly from a floor F (FIG. 2) and is preferably of a masonry construction, such as cinder blocks/brick and mortar. A novel coin/token vault 25 is partially though substantially entirely embedded within the wall 14 as are two meter boxes or coin/token acceptors 26, 27, each being identical to the Meter Box with Removable Hinge Door disclosed and illustrated in the aforementioned application Ser. No. 07/523,944. The meter box 26 has a door or face 28 opening into the bay 12, and a like door or face (not shown) of the meter box 17 opens into the bay 11. The doors 28 of the meter boxes 26, 27 each have a coin slot 30, a coin return slot 31 and a selector dial 32 which function in the manner described in the aforementioned patent application. Respective coins/token guide tubes 33, 34 connect the interior of the respective meter boxes 26, 27 with the interior of the coin/token vault 25 in a manner to be described more fully hereinafter, but the purpose thereof is to immediately guide coins/token deposited into the coin/token slot 30 and accepted by the coin acceptor boxes 26, 27 through the respective coin/token guide tubes 33, 34 into the coin/-token vault 25.

Figure 3:
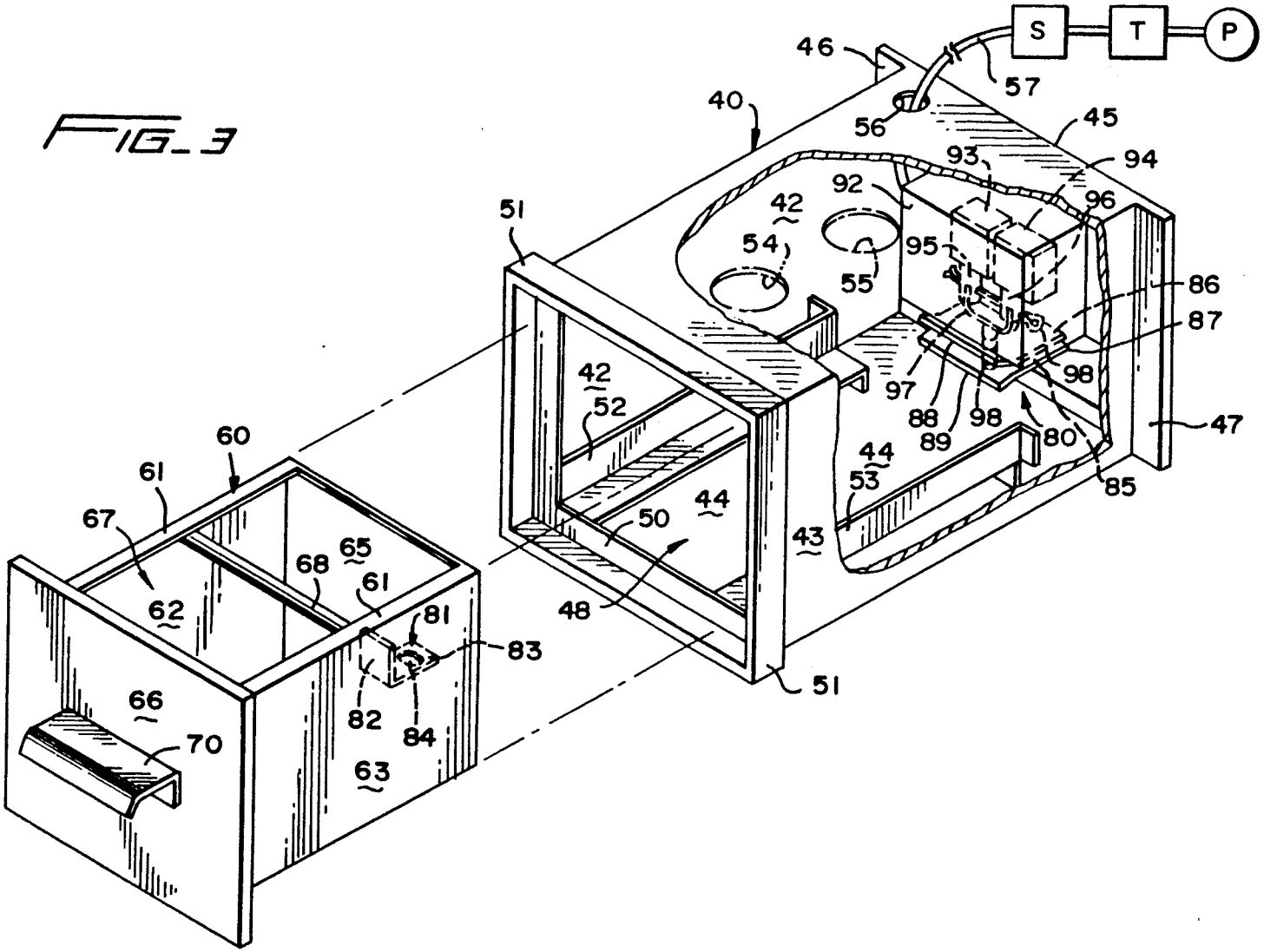
FIG. 3 is a fragmentary perspective view of the coin/token vault, and illustrates a housing and a drawer thereof.
Figure 4:
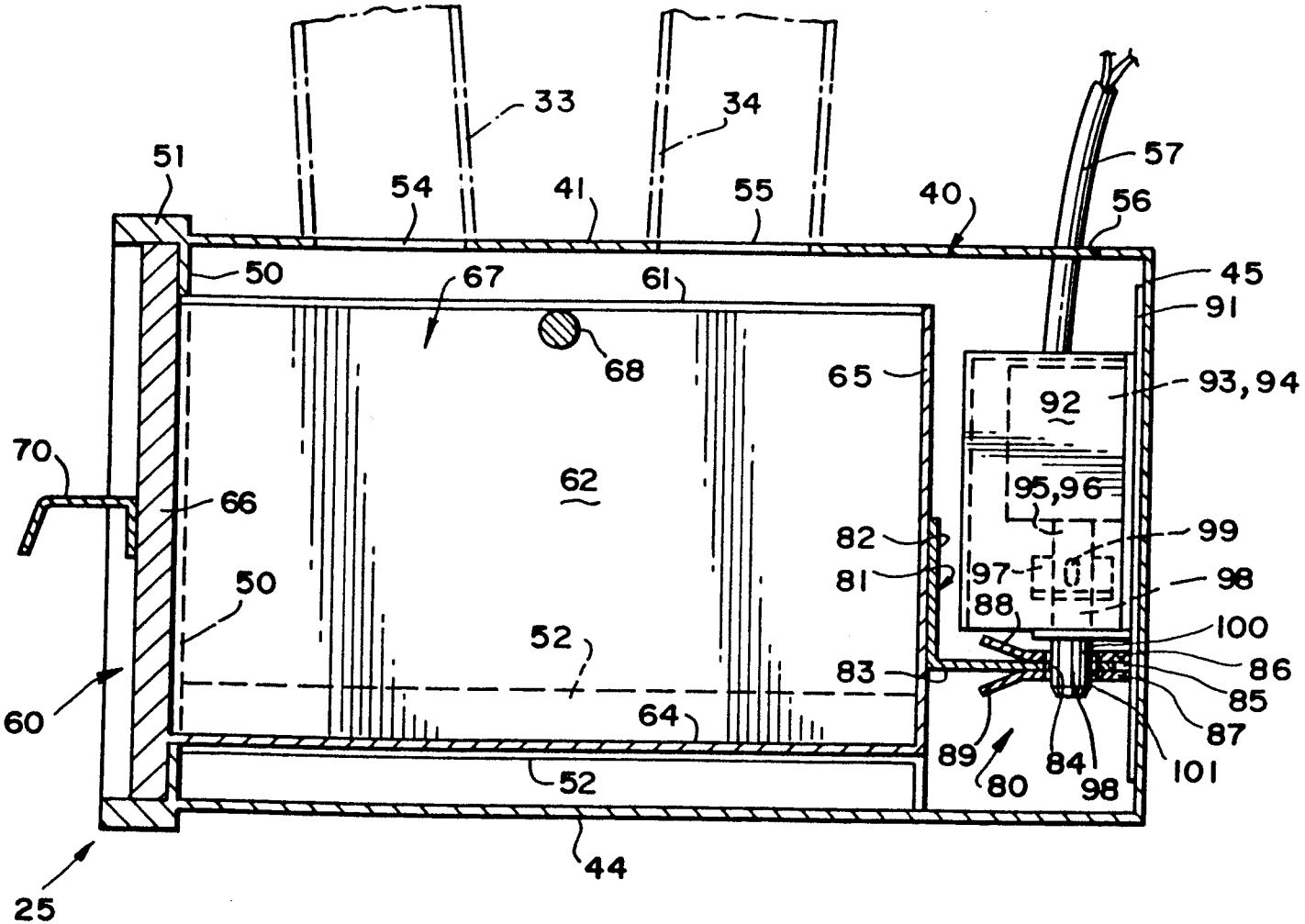
FIG. 4 is a vertical cross sectional view through the coin/token vault with the drawer in its closed position, and illustrates a vertical pin carried by the housing engaged in an opening of a tongue carried by the drawer in the locked position of the latter.

Reference is now made to FIGS. 3 and 4 of the drawings which more fully illustrate the coin/token vault 25 and two major components thereof, namely, a housing 40 and a drawer 60, both of which are constructed from stainless steel.

The housing 40 is of a generally rectangular configuration and is defined by a top wall 41, a first side wall 42, a second side wall 43 parallel to the side wall 42, a bottom wall 44 and a rear wall 45 having oppositely directed laterally projecting flanges 46, 47 extending between the walls 41, 44.

A first generally rectangular opening 48 is formed in a front wall 50 of the housing 40 and the front wall 50 is in turn bounded and reinforced by a relatively heavy frame 51. A pair of guides 52, 53 are in generally parallel relationship to each other, are generally L-shaped in transverse cross-section, and are designed to smoothly and accurately guide the drawer 60 into and out of the housing 40 through the opening 48 thereof. The guide 52 is welded to the front wall 50 and end flanges thereof (unnumbered) remote from the front wall 50 are welded to the side wall 42 and to the bottom wall 44. The guide 53 is similarly welded to the front wall 50 and flanges thereof (unnumbered) are welded to the bottom wall 44 and the side wall 43.

Figure 2:
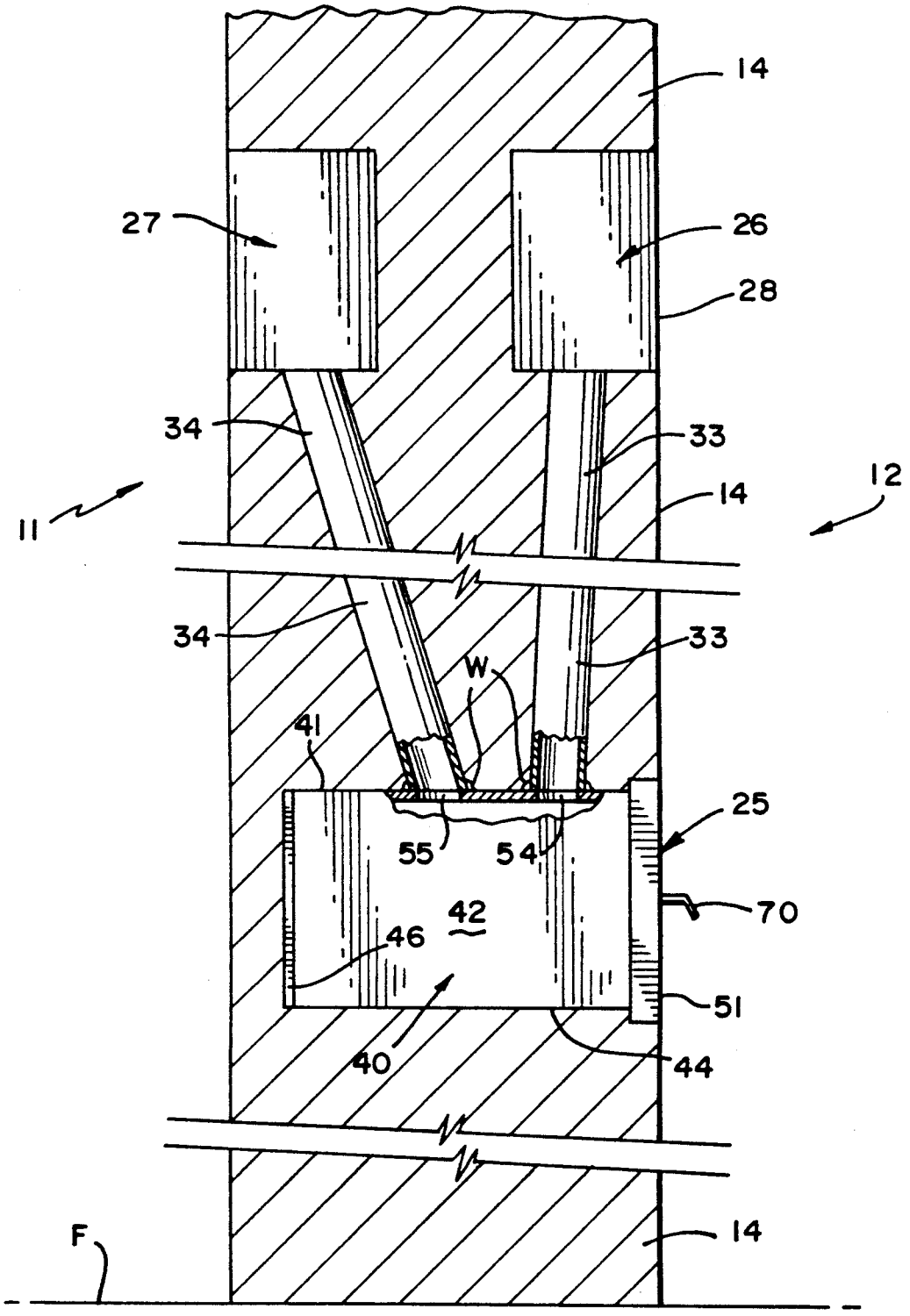
FIG. 2 is an enlarged fragmentary vertical sectional view taken through the central upstanding wall of FIG. 1, and illustrates details of the coin/token meter boxes or acceptors, the guide tubes, and the coin/token vault.

The top wall 41 of the housing 40 also has a pair of second openings 54, 55 (FIGS. 2 and 3) which are in registration with the coin/token guide tubes 33, 34, respectively. Welds W (FIG. 2) connect the coin/token guide tubes 33, 34 to the top wall 41 of the housing 40 in registry with the respective openings 54, 55, as is shown in FIG. 2. Another opening 56 (FIG. 3) is provided in the top wall 41 through which passes an electrical conductor or wire 57 which is in turn connected at a remote location (not shown) to a key switch S, a transformer T and a source of electrical power P.

The drawer 60 is of a generally rectangular configuration and includes a top wall 61 which defines a generally rectangular opening 67, a side wall 62, a side wall 63 parallel to the side wall 62, a bottom wall 64, a rear wall 65 and a front wall 66. A tubular carrying handle 68 is located generally centrally between the walls 65, 66 and is welded to the walls 62, 63. A relatively smooth handle 70 is welded to the wall 66. The periphery of the wall 66 is contoured to mate extremely close to the internal periphery of the frame 51 (see FIG. 4) to virtually preclude the successful use of any type of tool by a thief in an effort to jimmy the drawer 60 relative to the housing 40. Furthermore, the smooth handle 70 virtually prevents any type of tool from being used to gain purchase or leverage thereagainst, and the handle 70 is also constructed of the thinnest of stainless steel material defining the drawer 60. Therefore, any efforts at using the handle 70 to remove the drawer 60 from the housing 40 will result in the handle 70 being bent, broken or torn from the front wall 66, but the drawer 60 itself will not be removed from its closed and locked position (FIG. 4).

Means generally designated by the reference numeral 80 are provided for locking the drawer 60 in the closed position (FIG. 4) thereof relative to the housing 40. The locking means 80 includes a generally L-shaped bracket 81 having one leg 82 welded to the rear wall 65 of the drawer 60 and another generally horizontal leg or tongue 83 provided with an opening 84 therein. The leg 83 is aligned with a slot 85 (FIG. 4) defined by a pair of spaced plates 86, 87 having respective flared ends 88, 89. The ends of the plates 86, 87 opposite the flared ends 88, 89 are welded to a plate 91 which is rigidly though removably secured to the rear wall 45 of the housing 40. Though not illustrated, the latter securement is achieved by welding threaded studs to the interior of the rear wall 45 which project through openings (not shown) in the plate 91 with nuts being secured to the threaded studs. A rectangular housing 92 is welded to the plate 91 and carries internally thereof two electromagnetic coils 93, 94 (FIG. 3) each of which includes a respective core 95, 96. A shallow generally U-shaped bracket 97 has its legs (unnumbered) introduced into slots (unnumbered) of the cores 95, 96 and a cotter pin 99 passes through openings (unnumbered) in the cores 95, 96 and the legs (unnumbered) of the bracket 97 to releasably secure the bracket 97 to the cores 95, 96. A generally vertically disposed depending cylindrical latch or pin 98 is welded to and projects downwardly from the bracket 97 and projects under the influence of gravity through openings 100, 101 (FIG. 4) of the respective plates 86, 87. When the switch S (FIG. 3) is open current does not flow through the conductor 57 and therefore the cores 95, 96 and the pin 98 drop downwardly under the influence of gravity to the position shown in FIGS. 3 and 4. However, when the switch S is key operated by authorized personnel, the circuit from the transformer T is closed energizing the coils 93, 94 drawing the cores 95, 96, respectively, upwardly which in turn draws the pin 98 clear of the slot 84 (FIG. 4) of the leg or tongue 83. When the pin 98 is drawn upwardly clear of the slot 84, the drawer 60 can be pulled to the left, as viewed in FIG. 4, to gain access to the interior thereof through the opening 67. Once the coins/tokens are removed from the drawer 60, the drawer is reinserted into the housing 40 sliding along the guides 52, 53 with the tongue 83 eventually being guided by the flared ends 88, 89 toward and into the gap 85. At this point the wall 66 of the drawer 60 contacts the front wall 90 of the housing 40 with the openings 84, 100 and 101 in alignment. The key switch S is turned to open the circuit between the transformer T and the coils 93, 94 de-energizing the latter and allowing gravity to drop the pin 98 into the openings 84, 100 and 101 thereby again relocking the drawer 60 and preventing its unauthorized removal from the housing 40.

From the foregoing description it will be readily apparent though one might gain access to the meter /coin/token boxes 26, 27, it is virtually impossible to gain access to the interior of the coin/token vault 25 except by virtually knocking down the wall 14. However, since the latter is constructed of brick and block, this is a highly unlikely occurrence. Furthermore, any prying or pulling of the coin/token vault 25 to the right, as viewed in FIG. 2, will be resisted by the flanges 46, 47 which are embedded in the masonry. Even if a grip could be placed upon the vault 25, it would be virtually impossible to pull the vault 25 from within the upstanding wall 14.

It is also noted that the electromagnetic coils 93, 94 are wired in series so that if one becomes disabled or burned out, the other would remain operative. Furthermore, the force of each individual electromagnetic coil 93, 94 is sufficient in and of itself to retract the pin 98 to its uppermost position. Thus, should either of the coils 93, 94 fail, the power of the remaining coil will be sufficient to unlock the drawer by the retraction of the pin 98 to its fully uppermost position.

Although a preferred embodiment of the invention has been specifically illustrated and described herein, it is to be understood that minor variations may be made in the apparatus without departing from the spirit and scope of the invention, as defined the appended claims.

We claim:

1. A car wash system comprising a car washing area which includes an upstanding wall, a coin/token box disposed above a coin/token vault and both being secured to said upstanding wall, a coin/token tube between said coin/token box and said coin/token vault through which coins/tokens introduced into said coin/-token box incident to a car washing operation are guided into said coin/token vault, said coin/token vault includes a housing and a drawer movable relative thereto, means for locking said movable drawer to said housing, means for releasing said locking means to permit the drawer to open relative to said housing to effect access to coins/tokens housed therein, said locking means including a pin carried by one of said drawer and hosing and an opening defined by another of said drawer and housing, said pin being constructed and arranged for gravity introduction into said opening in a locked condition of said drawer to prevent said drawer from opening, said releasing means including a pair of electromagnetic coils each individually capable of moving said pin upon energization thereof, a core associated with each electromagnetic coils, and means for connecting said cores to said pin whereby energization of only one electromagnetic coil is sufficient to move said pin against gravity out of said opening to an unlocked position at which said drawer can be opened.

2. The car wash system as defined in claim 1 including another coin/token box disposed above said coin/-token vault and being secured to said upstanding wall, another coin/token tube between said another coin/-token box and said coin/token vault through which coins/tokens introduced into said another coin/token box incident to a car washing operation are guided into said coin/token vault, and said first-mentioned and another coin/token boxes are disposed at opposite sides of said upstanding wall.

3. The car wash system as defined in claim 1 wherein said movable drawer is in slidable opening and closing relationship to said housing.

4. The car wash system as defined in claim 1 wherein said pin is oriented generally vertically.

5. The car wash system as defined in claim 1 wherein said pin is disposed in vertically depending relationship relative to said cores.

6. The car wash system as defined in claim 1 wherein said coin/token box, coin/token vault and coin/token tube are at least partially housed within said upstanding wall.

7. The car wish system as defined in claim 1 wherein said coin/token box and coin/token vault are partially housed within said upstanding wall, and said coin/token tube is totally housed within said upstanding wall.

8. The car wash system as defined in claim 2 wherein said coin/token boxes, coin/token vault and coin/token tubes are at least partially housed within said upstanding wall.

9. The car wash system as defined in claim 2 wherein said coin/token boxes, coin/token vault and coin/token tubes are at least partially housed within said upstanding wall, and said coin/token boxes have front coin-receiving faces which are exposed on opposite sides of said upstanding wall.

10. The car wash system as defined in claim 2 wherein said coin/token boxes and coin/token vault are partially housed with said upstanding wall, and said coin/token tubes are totally housed within said upstanding wall.

11. The car wash system as defined in claim 2 wherein said coin/token boxes and coin/token vault are partially housed with said upstanding wall, said coin/token tubes are totally housed within said upstanding wall, and said coin/token boxes have front coin/token-receiving faces which are exposed on opposite sides of said upstanding wall.

12. The car wash system as defined in claim 1 wherein the strength of each of electromagnetic coil when energized is sufficient individually to raise both cores and said pin against gravity to move said pin to said unlocked position.

13. The car wash system as defined in claim 1 wherein said pin is oriented generally vertically.

14. The car wash system as defined in claim 12 wherein said pin is oriented generally vertically.

15. A car wash system comprising a car wash area, a coin/token vault adapted to receive coins/tokens incident to a car washing operation, said coin/token vault includes a housing and a drawer movable relative thereto, means for locking said movable drawer to said housing, means for releasing said locking means to permit the drawer to open relative to said housing to effect access to coins/token housed therein, said locking means including a pin carried by one of said drawer and housing and an opening defined by another of said drawer and housing, said pin being constructed and arranged for gravity introduction into said opening in a locked condition of said drawer to prevent said drawer from opening, said releasing means including a pair of electromagnetic coils each individually capable of moving sd pin upon energization thereof, a core associated with each electromagnetic coil, and means for connecting said cores to said pin whereby energization of only one electromagnetic coil is sufficient to move said pin against gravity out of said opening to an unlocked position at which said drawer can be opened.

16. The car wash system as defined in claim 15 wherein the strength of each of electromagnetic coil when energized is sufficient individually to raise both cores and said pin against gravity to move said pin to said unlocked position.

17. The car wash system as defined in claim 15 wherein said pin is oriented generally vertically.

18. The car wash system as defined in claim 16 wherein said pin is oriented generally vertically.

* * * * *